United States Patent [19]

Ward et al.

[11] Patent Number: 5,054,204

[45] Date of Patent: Oct. 8, 1991

[54] SHOTGUN SIGHTING DEVICE

[76] Inventors: Troy L. Ward, 45749 Classic Way; Terry L. Bilbey, 45801 Clubhouse Dr., both of Temecula, Calif. 92390

[21] Appl. No.: 657,412

[22] Filed: Feb. 19, 1991

[51] Int. Cl.[5] ..... F41G 1/16

[52] U.S. Cl. ..... 33/233

[58] Field of Search ..... 33/233, 234, 244, 245, 33/261, 251; 42/100, 101

[56] References Cited

U.S. PATENT DOCUMENTS 2,795,048 6/1957 Seymour et al. ..... 33/233

FOREIGN PATENT DOCUMENTS 322711 11/1934 Italy ..... 33/233

139535 7/1930 Switzerland ..... 33/251

*Primary Examiner*—Harry N. Harbian

*Attorney, Agent, or Firm*—Leon Gilden

[57] ABSTRACT

An attachment for use in association with a shotgun, defined by a clip member formed of memory retentent material such as spring steel mounted about a rib and barrel of an associated shotgun adjacent the muzzle of the shotgun to provide visual indication of a shotgun pattern at a predetermined yardage. The device is defined by a discontinuous sighting tube mounted to spaced left and right flaqnges, wherein the flanges each include a medially positioned and upwardly projecting respective left and right abutment member and downwardly depending plural pairs of legs for securement in a resilient manner in a shotgun rib.

6 Claims, 4 Drawing Sheets

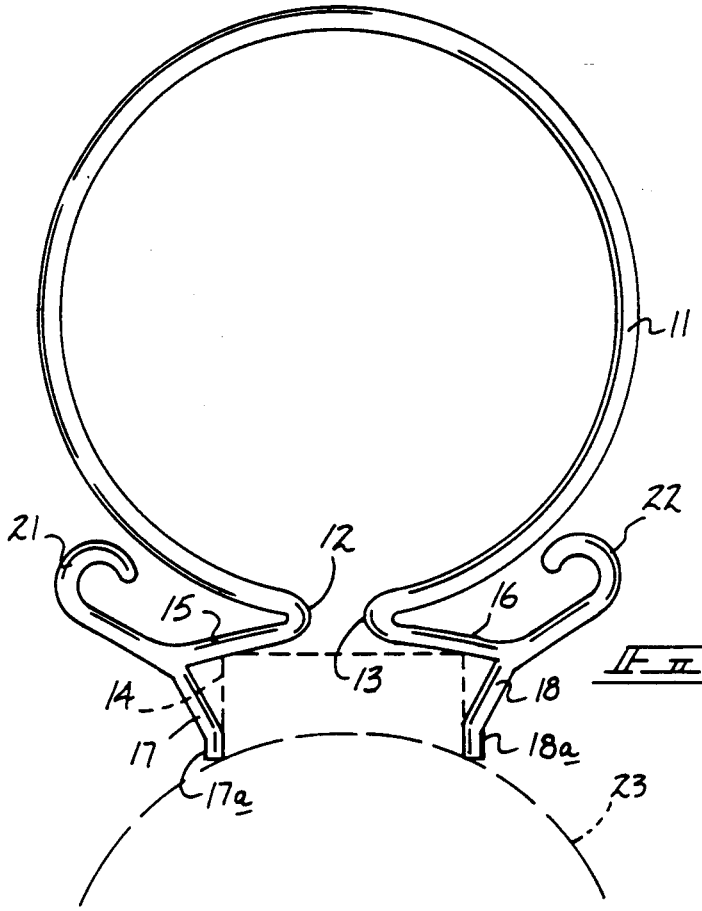
Fig 3
Fig 4
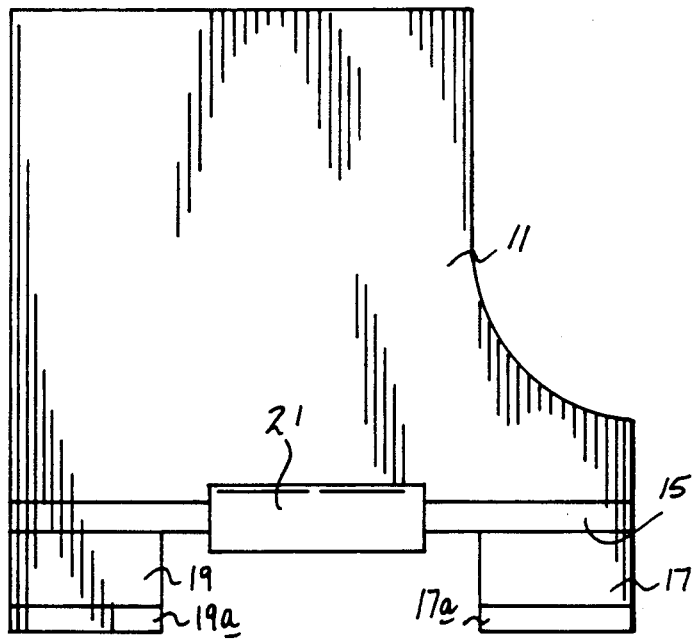

SHOTGUN SIGHTING DEVICE

BACKGROUND OF THE INVENTION

1. Field of the Invention

The field of invention relates to sighting devices, and more particularly pertains to a new and improved shotgun sighting for providing visible indication of shotgun pattern at a predetermined yardage.

2. Description of the Prior Art

Conventional shotgun sighting devices typically include a forward bead and occasionally a medial bead to provide a sighting plane for the shotgun. Such devices do not provide indication of shotgun pattern, but merely provide an orientation for the shotgun barrel during a shooting procedure. The instant invention attempts to overcome deficiencies of the prior art by effectively providing visible indication to a shooter of a thirty inch shotgun pattern at a typical thirty yard distance providing an effective pattern range for use in various shooting sports. Examples of prior art sighting devices may be found in U.S. Pat. No. 893,751 to Putney wherein a gun sight utilizes relative repositionable disks for providing various patterns in a sighting arrangement.

U.S Pat. No. 1,245,321 to Etherington sets forth a rear sight for use in rifles and the like, wherein a disk is formed with an adjustable aperture.

U.S. Pat. No. 1,517,363 to Kauch, et al. sets forth a prior art peep sight for use in firearms utilizing an exterior ring and a medially positioned peep sight ring, wherein the peep sight ring is vertically and adjustably mounted relative to an associated firearm.

U.S. Pat. No. 1,857,782 to Herman sets forth a forward sight utilizing a relatively adjustable diametrically opposed pin to vary a spacing between the pins in sighting of a distant target.

As such, it may be appreciated that there continues to be a need for a new and improved shotgun sighting device as set forth by the instant invention which addresses both the problems of ease of use as well as effectiveness in construction in mounting in a retrofit manner to an existing shotgun organization and in this respect, the present invention substantially fulfills this need.

SUMMARY OF THE INVENTION

In view of the foregoing disadvantages inherent in the known types of firearm sighting structure now present in the prior art, the present invention provides a shotgun sighting device wherein the same is formed of a spring-like member mounted to a rib and barrel structure of a shotgun for providing optical understanding of a shotgun pellet pattern at a predetermined yardage. As such, the general purpose of the present invention, which will be described subsequently in greater detail, is to provide a new and improved shotgun sighting device which has all the advantages of the prior art shotgun sighting organizations and none of the disadvantages.

To attain this, the present invention provides an attachment for use in association with a shotgun, defined by a clip member formed of memory retentent material such as spring steel mounted about a rib and barrel of an associated shotgun adjacent the muzzle of the shotgun to provide visual indication of a shotgun pattern at a predetermined yardage. The device is defined by a discontinuous sighting tube mounted to spaced left and right flanges, wherein the flanges each include a medially positioned and upwarldy projecting respective left and right abutment member and downwardly depending plural pairs of legs for encircling in a resilient manner a shotgun rib.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is imPortant, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shotgun sighting device which has all the advantages of the prior art shotgun sighting organizations and none of the disadvantages.

It is another object of the present invention to provide a new and improved shotgun sighting device which may be easily and efficiently manufactured and marketed.

It is a further object of the present invention to provide a new and improved shotgun sighting device which is of a durable and reliable construction.

An even further object of the present invention is to provide a new and improved shotgun sighting device which is susceptible of a low cost of manufacture with regard to both materials and labor, and which accordinglY is then susceptible of low prices of sale to the consuming public, thereby making such shotgun sighting devices economically available to the buying public.

Still yet another object of the present invention is to provide a new and improved shotgun sighting device which provides in the apparatuses and methods of the prior art some of the advantages thereof, while simultaneously overcoming some of the disadvantages normally associated therewith.

Still another object of the present invention is to provide a new and improved shotgun sighting device with ease of retrofit and mounting to an existing shotgun organization.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a frontal elevational view of the instant invention in an expanded orientation mounted to an existing shotgun rib.

FIG. 4 is an orthographic side view of the instant invention.

DESCRIPTION OF THE PREFERRED EMBODIMENT

Figure 1:
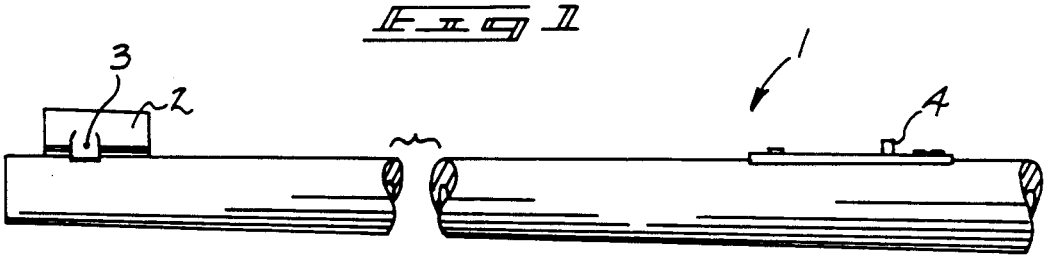
FIG. 1 is an orthographic side view of a prior art firearm sighting device.
Figure 2:
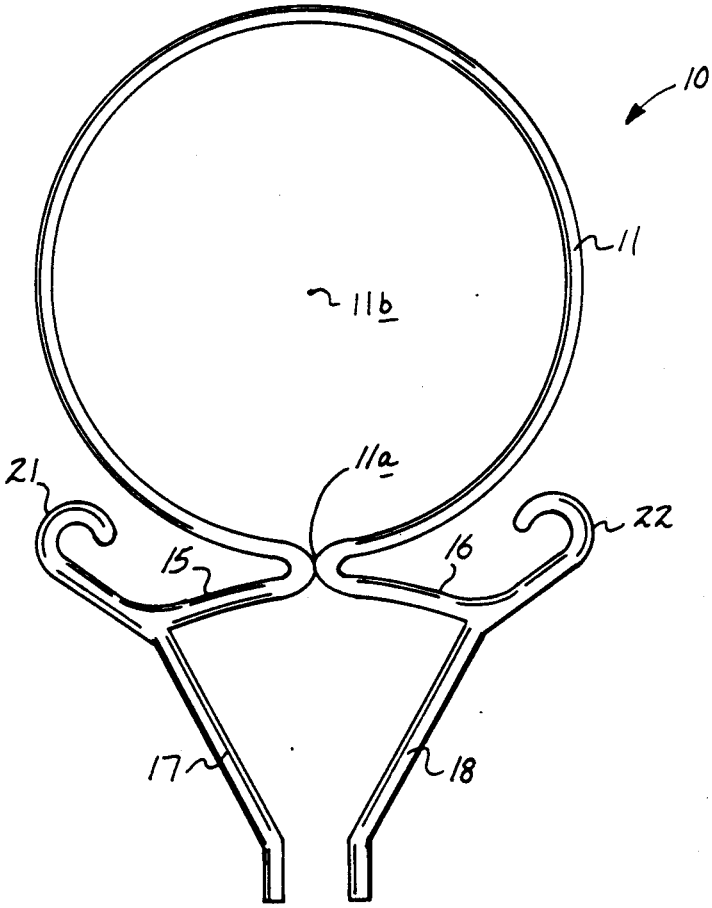
PRIOR ART Fig 2
FIG. 2 is a frontal elevational view of the instant invention.
Figure 5:
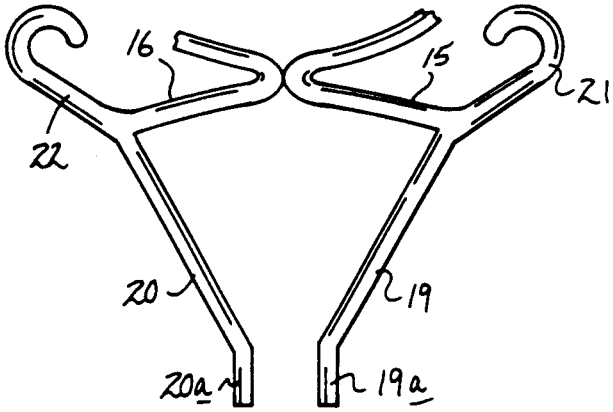
FIG. 5 is a rear orthographic view of the instant invention.
Figure 6:
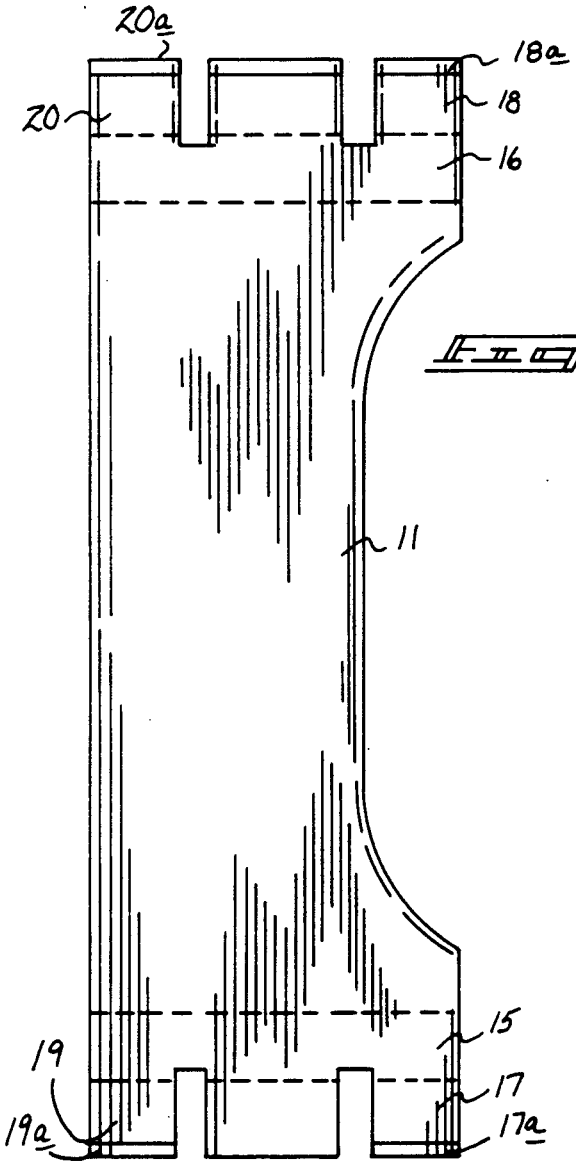
FIG. 6 is a top plan view of the instant invention in a planar blank configuration.

With reference now to the drawings, and in particular to FIGS. 1 to 8 thereof, a new and improved shotgun sighting device embodying the principles and concepts of the present invention and generally designated by the reference numeral 10 will be described.

FIG. 1 illustrates a prior art firearm sighting organization 1, wherein a forward tube member 2 utilizing opposed diametrically mounted pins 3 is mounted to a barrel of an existing firearm in association with a rear sight, in a manner as set forth in U.S. Pat. No. 1,857,782.

Figures 7, 8:
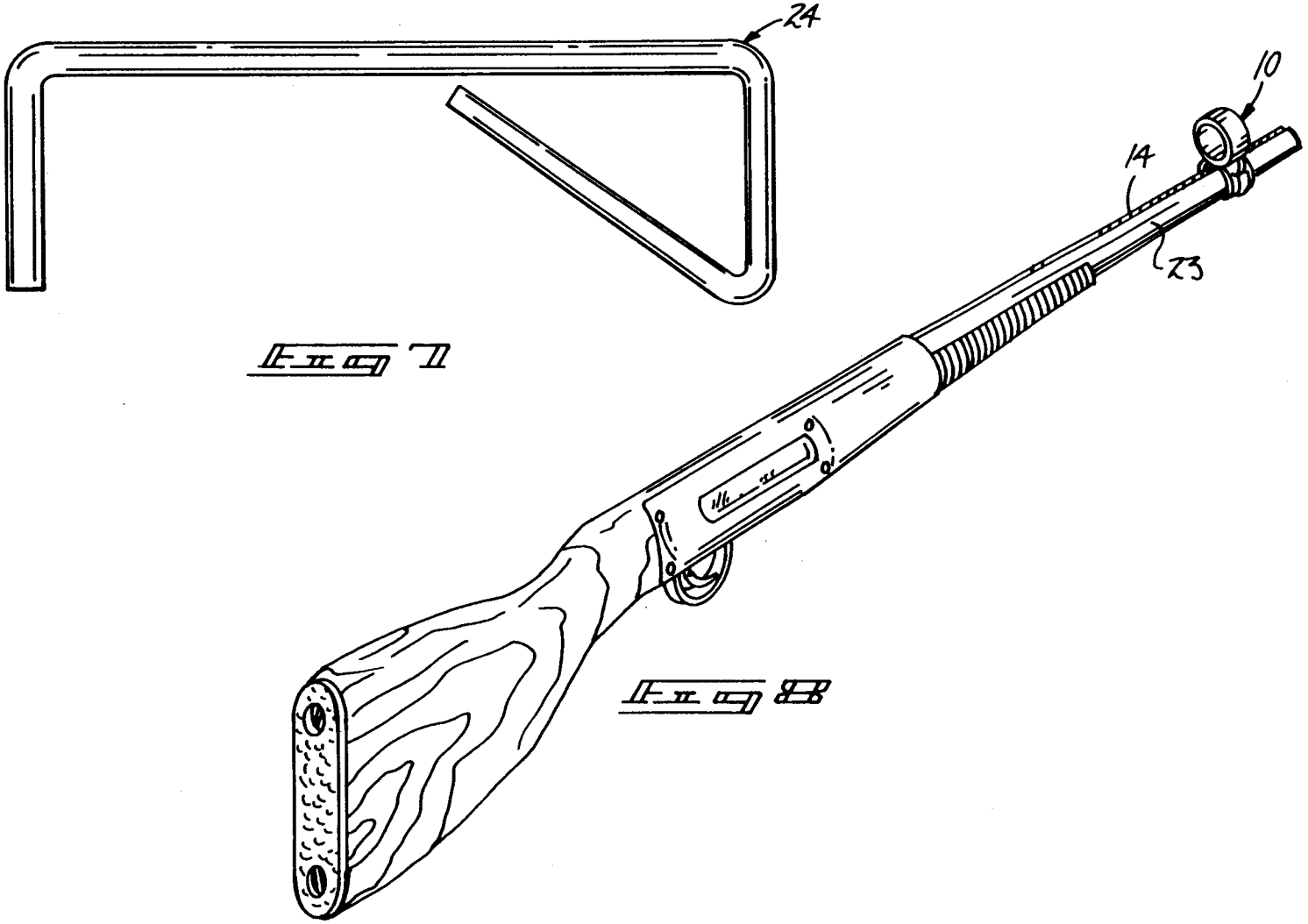
FIG. 7 is a spreader tool utilized in removal and adjustment of the device when mounted to an existing shotgun.
FIG. 8 is an isometric illustration of the organization mounted to a shotgun structure.

More specifically, the shotgun sighting device 10 of the instant invention essentially comprises a discontinuous sighting tube 11 that is coaxially aligned and includes a straight contact line 11*a* arranged parallel to an axis 11*b* defined by the sighting tube 11. The contact line 11*a* is effected by a left tube abutment surface 12 (see FIG. 3) and a right tube abutment surface 13 that are arranged to engage opposed sides of a shotgun rib 14 in a clamping manner. A left spacer flange 15 extends rearwardly of the left tube abutment surface 12, with a right spacer flange 16 extending rearwardly of the right tube abutment surface 13. The left and right flanges 15 and 16 respectively extend in opposed orientations relative to one another to underlie the tube 11 and are coextensive with the tube 11, as illustrated in FIG. 4 for example. The terminal ends of respective left and right flanges 15 and 16 include respective left and right first leg members 17 and 18 extending downwardly therefrom to underlie the sighting tube 11 and define the first clamp pair, with the left first leg member 17 including a lower left first leg member 17*a* and the right leg member 18 including a lower right leg member 18*a*. The lower leg members 17*a* and 18*a* are arranged to extend below the shotgun barrel 23 to provide a grasping surface for ease of removal of the device 10. positioned medially of each left and right flange 15 and 16 are respective left and right abutment member 21 and 22 to provide limiting of spreading of the leg pairs 17 and 18, and a second clamp pair defined by respective left and right second leg members 19 and 20 that are integrally mounted and downwardly extending of rear terminal end portions of the left and right flanges 15 and 16. The left first and second leg members are arranged parallel relative to one another, with the right first and second leg members 19 and 20 also arranged parallel relative to one another. The left and right second leg members include respective left and right lower leg member portions 19*a* and 20*a*. The abutment members 21 and 22 are each of a hook shaped configuration defining an arcuate abutment surface to minimize damage to the tube 11 during deflection of the first and second clamp pairs defined by the first and second leg members when mounting the device to a shotgun rib. FIG. 7 illustrates the use of a spreader tool 7 that may be employed to assist in spreading of the leg members when the device is mounted to a shotgun rib, in a manner as set forth in FIG. 8. Typically, the tube 11 is defined by a diameter of 0.75 inches when mounted to an associated shotgun rib, but may vary from 11/16ths to $\frac{7}{8}$ths inches in use to thereby provide a visual sighting of a thirty inch pattern, typically thirty yards, by an individual in a shotgun shooting procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected bY LETTERS PATENT of the United States is as follows:

1. A shotgun sighting device in combination with a firearm, wherein the firearm includes an elongate barrel and a rib mounted coaxially of the barrel to a top surface thereof, and the device comprises, a sighting tube, the sighting tube including a discontinuous side wall defining a left abutment surface parallel to a right abutment surface, wherein the left and right abutment surfaces are each arranged parallel to an axis of the sighting tube, and the left and right abutment surface arranged for engagement with opposed sides of the rib, and a left flange formed coextensively to the left abutment surface, and a right flange formed coextensively to the right abutment surface, wherein the left and right flanges are positioned underlying the tube, and the left and right flanges each include cooperative left and right clamp legs for securement to the rib.

2. An apparatus as set forth in claim 1 wherein the left and right clamp legs include a left first leg member mounted to a forward end of the left flange, and a right first leg member mounted to a forward end of the right flange, wherein the respective left and right first leg members define a first clamp pair, and a left second leg member mounted to a rear end of the left flange, and a right second leg member mounted to a rear terminal end portion of the right flange, wherein the left and right second leg members define a second clamp pair, wherein the left first leg members are arranged parallel to the left second leg member and the right first leg members are arranged parallel to the right first leg member.

3. An apparatus as set forth in claim 2 wherein the device is formed of memory retentant material, and wherein the left first leg member is biased towards the right first leg member and the left second leg member is biased towards the right second leg member.

4. An apparatus as set forth in claim 3 wherein the left flange includes a left abutment member mounted integrally to the left flange spaced above the first and second clamp pairs adjacent the tube and the right flange includes a right abutment member positioned above the first and second clamp pairs positioned adjacent the tube, wherein the abutment members each define an arcuate surface in orientation with the tube.

5. An apparatus as set forth in claim 4 wherein each leg member includes an extension, wherein each extension defines an obtuse angle between each extension and a respective leg member.

6. An apparatus as set forth in claim 5 wherein the left and right abutment surfaces are in contiguous communication with one another in a first position and are spaced apart in a second position when in engagement with the rib, and wherein the tube is defined by a diameter within a range of 11/16ths inches to $\frac{7}{8}$ths inches to define a thirty inch shotgun pellet pattern at substantially thirty yards from a forward terminal end of the barrel.

* * * * *